US005807157A

United States Patent [19]

Penjuke

[11] Patent Number: 5,807,157

[45] Date of Patent: Sep. 15, 1998

[54] DEVICE AND METHOD FOR INTERNALLY LIGHTING A MYLAR BALLOON

[76] Inventor: Daniel Penjuke, 64 Albert Ave., Aldan, Pa. 19018

[21] Appl. No.: 779,485

[22] Filed: Jan. 7, 1997

[51] Int. Cl.[6] ..... A63H 3/06; F21K 7/00

[52] U.S. Cl. ..... 446/220; 446/224; 446/485; 362/262

[58] Field of Search ..... 446/220, 224, 446/485; 362/262, 296

[56] References Cited

U.S. PATENT DOCUMENTS

| | | | |
|---|---|---|---|
| 3,592,157 | 7/1971 | Schwartz | 446/220 |
| 5,083,250 | 1/1992 | Malcolm | 362/253 |
| 5,117,344 | 5/1992 | Perez | 362/352 |
| 5,119,281 | 6/1992 | Akman | 362/253 |
| 5,499,941 | 3/1996 | Penjuke | 446/222 |

FOREIGN PATENT DOCUMENTS

| | | | |
|---|---|---|---|
| 35139 | 10/1925 | Denmark | 446/220 |
| 405137847 | 6/1993 | Japan | 446/220 |

*Primary Examiner*—Robert A. Hafer
*Assistant Examiner*—Laura Fossum
*Attorney, Agent, or Firm*—LaMorte & Associates

[57] ABSTRACT

A device and method for illuminating the interior of a balloon. The device includes an elongated tube that is between three inches and twelve inches in length. A light source, such as an incandescent bulb or an LED, is coupled to one end of the elongated tube. A wire passes through the center of the tube and provides power to the light source. The elongated tube is passed into the collapsible fill conduit of a mylar-type of balloon. The elongated tube supports the light source in the interior of the balloon. The collapsible fill tube collapses around the elongated tube, thereby creating a substantially air impervious seal in between the balloon and the elongated tube. The presence of the wire in the elongated tube enables the light source in the tube to be coupled to a power source outside of the balloon without allowing the air in the balloon from escaping.

9 Claims, 3 Drawing Sheets

DEVICE AND METHOD FOR INTERNALLY LIGHTING A MYLAR BALLOON

BACKGROUND OF THE INVENTION

1. Field of the Invention

The present invention relates to illumination devices capable of being positioned within an inflated balloon. More particularly, the present invention relates to devices that retains a light source within a balloon and couples that light source to an external power source, while maintaining the balloon in an inflated state.

2. Prior Art Statement

U.S. Pat. No. 5,499,941 to Daniel Panjuke, the inventor herein, entitled Balloon Inflation Device With Light, discloses a device for positioning a light within a traditional latex balloon. The device relies upon the elastic properties of the latex balloon to create a seal around the device and thereby prevent the balloon from deflating.

Mylar balloons are made of mylar or similar plastics that do not have elastic properties. Consequently, devices such as that of U.S. Pat. No. 5,499,941 can not be used to position lights within the balloon. When first introduced, mylar balloons were traditionally opaque. As such, there was no need to light such balloons internally. Traditional mylar balloons were typically manufactured by placing one round piece of opaque mylar over another round piece of opaque mylar and joining the edges in an air tight manner. One joined, the two pieces of opaque mylar created an internal chamber that could be filled with helium or air, thus creating the balloon. However, recently mylar balloons have been manufactured by placing a piece of transparent material over a traditional piece of opaque mylar and joining the two materials together along their peripheral seam. The result is a balloon that is opaque on one side and transparent on the other. By printing different messages and images on both the opaque mylar in the balloon and on the transparent wall of the balloon, an overall balloon assembly is created that provides a three-dimensional appearance to the images and messages printed.

Referring to FIG. 1, a prior art mylar balloon 10 is shown. The balloon 10 has a back surface 12 made from an opaque piece of mylar. The front surface 14 of the balloon is made from a translucent piece of plastic that is joined to the opaque mylar around the peripheral edge. In many such balloons, both the back surface 12 and the front surface 14 extend into a stem region 18, wherein the stem region 18 provides the needed means to fill the balloon with air, helium or the like.

Many modern mylar balloons are manufactured with a collapsible fill conduit 20 that is positioned in the stem region 18 of the balloon 10 in between the back surface 12 and the front surface 14. The collapsible fill conduit 20 is a structure that originates in the stem region 18 of the balloon 10 and extends upwardly into the interior of the balloon 10. The collapsible fill conduit 20 is made of two sections of flexible plastic that are partially joined together along their side edges 21, 22, thereby creating a central open conduit 24. The open conduit 24 communicates with an open fill hole 26 that is manufactured in the stem region 18 of the balloon 10. To fill the balloon 10, gas is introduced into the open conduit 24 through the fill hole 26. The presence of the gas opens the conduit 24 and enables the gas to pass freely into the balloon 10. Once the pressure in the balloon 10 is greater than ambient, the filling source of gas can be removed. Since the gas in the balloon 10 is greater than the pressure of gas surrounding the balloon 10, the open conduit 24 collapses and seals itself after the source of gas is removed. The collapsed conduit 24 seals the interior of the balloon 10 and prevents the gases in the interior of the balloon from leaking out. A string or similar tether can then be tied to the stem region 18 of the balloon 18.

From the described function of the collapsible fill conduits used in mylar balloons, it will be understood that any light source introduced into the mylar balloon 10 would have to be introduced through the collapsible fill conduit 20. Furthermore, any external power source connected to a light source within the balloon would also have to extend through the collapsible fill conduit 20. However, the presence of foreign objects in the collapsible fill conduit 20 can prevent the conduit 20 from fully collapsing, thereby enabling the gas within the inflated balloon to escape.

A need therefore exists in the art for a device that can pass into the collapsible fill conduit of a mylar balloon and retain a light source within a mylar balloon without adversely effecting the performance of the balloons collapsible fill conduit. A need also exists for such a device that can be retroactively added to any mylar balloon with having to modify the physical structure of the balloon. These needs are satisfied by the present invention as described below.

SUMMARY OF THE INVENTION

The present invention is a device and method for illuminating the interior of a balloon. The device includes an elongated tube that is between three inches and twelve inches in length. A light source, such as an incandescent bulb or an LED, is coupled to one end of the elongated tube. A wire passes through the center of the tube and provides power to the light source. The elongated tube is passed into the collapsible fill conduit of a mylar-type of balloon. The elongated tube supports the light source in the interior of the balloon. The collapsible fill tube collapses around the elongated tube, thereby creating a substantially air impervious seal in between the balloon and the elongated tube. The presence of the wire in the elongated tube enables the light source in the tube to be coupled to a power source outside of the balloon without allowing the air in the balloon from escaping.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 2:
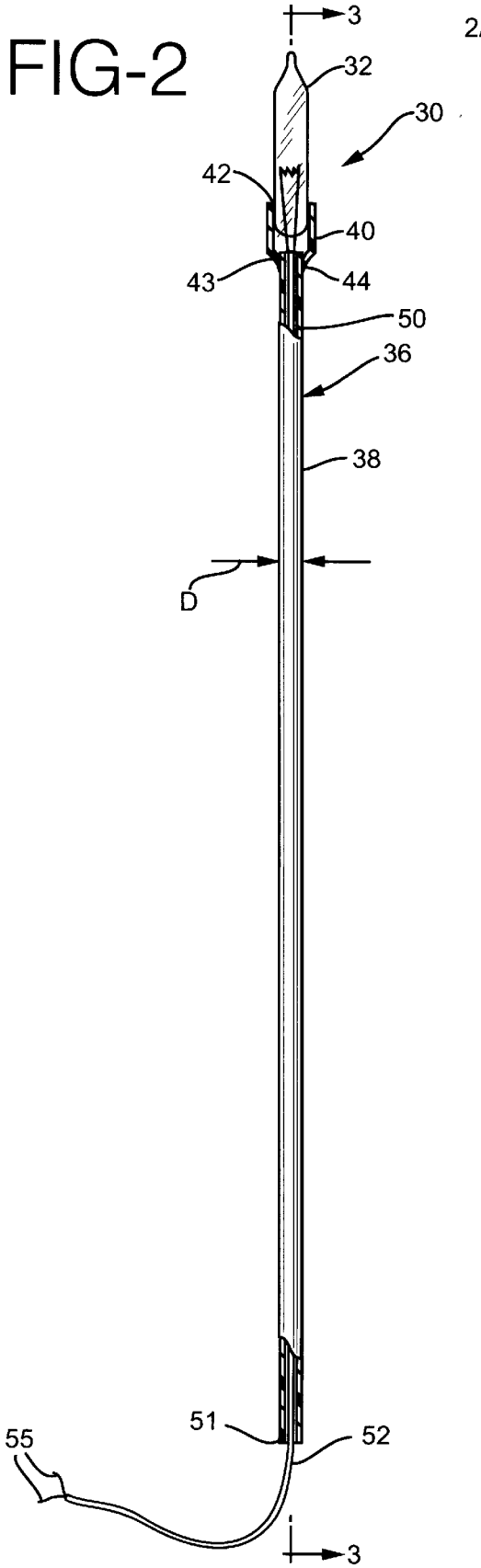
FIG. 2 is a partially fragmented front view of one preferred embodiment of the present invention device.
Figure 3:
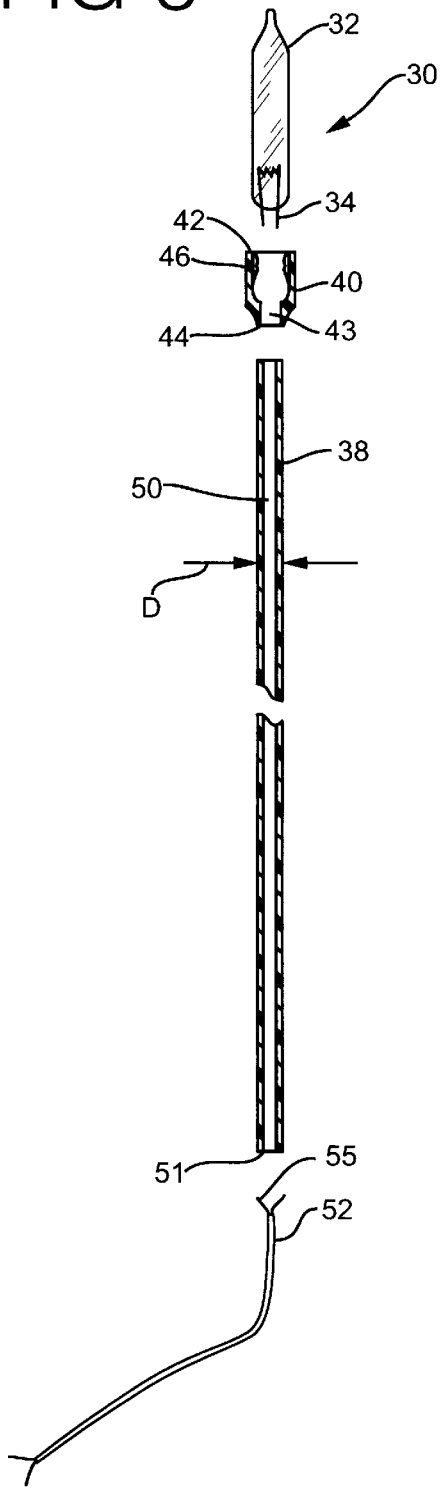
FIG. 3 is an exploded cross-sectional view of the embodiment shown in FIG. 2, viewed along section line 3—3.

Referring to FIG. 2 and FIG. 3, a first embodiment of the present invention illumination device 30 is shown. In the shown embodiment, a conventional incandescent bulb 32 is used as a light source. The incandescent bulb 32 has two conductive leads 34 (FIG. 3) that extend into the bulb 32 and connect to the filament within the bulb 32. The use of an incandescent bulb 32 is preferred but is not required. Other light sources such as light emitting diodes (LEDs) and the like can also be used. The use of an incandescent bulb 32 is preferred because of its low cost and high degree of light output.

The incandescent bulb 32 is retained at one end of an elongated support 36. The elongated support 36 is comprised of an elongated hollow tube 38 and a bulb receptacle 40 that attaches to one end of the tube 38. The bulb receptacle 40 is a cup shaped structure with an open top end 42 and a round aperture 43 at the opposite bottom end 44. The bulb receptacle 40 is sized to receive the bottom section of the incandescent bulb 32 through its open top end 42. The incandescent bulb 32 is affixed in place within the bulb receptacle 40 by a small amount of adhesive 46 (FIG. 3). The adhesive 46 retains the incandescent bulb 32 in place and creates an air impervious seal between the incandescent bulb 32 and the bulb receptacle 40.

Figure 1:
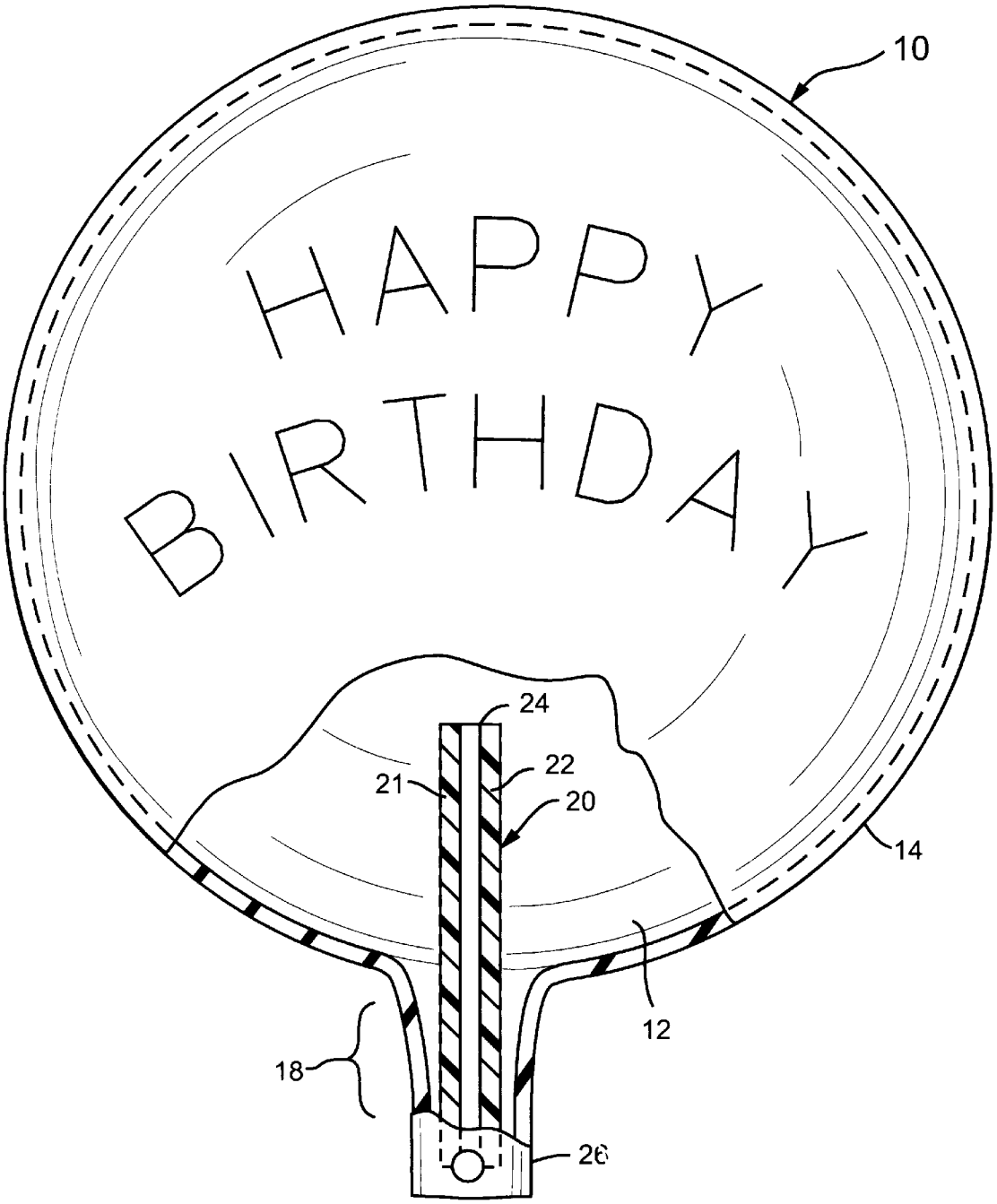
FIG-1 Prior Art
FIG. 1 is a partially fragmented front view of a prior art mylar balloon.

The hollow tube 38 passes into the aperture 43 at the bottom of the bulb receptacle 40, whereby the hollow tube 38 is affixed to the bulb receptacle 40 either by adhesive or with an interference fit. The hollow tube 38 preferably is very thin and has an external diameter D of less than 0.10 inches. The thinness of the hollow tube 38 is important in the sealing of the balloon, as will later be explained. The length of the hollow tube 38 depends upon the size of the mylar balloon to be illuminated. The length of the hollow tube 38 should be long enough to support the incandescent bulb 32 near the center of the balloon. As such, the hollow tube 38 must extend from the stem region 18 (FIG. 1) of the balloon to the center of the balloon. Consequently, the length of the hollow tube 38 is usually close to half the diameter of the balloon. Since most mylar balloons range in diameter from six inches to two feet, the length of the hollow tube 38 is preferably between three inches and twelve inches.

The hollow tube 38 defines a lumen 50 that extends down the center of the tube 38. The lumen 50 communicates with the interior of the bulb receptacle 40 when the hollow tube 38 is affixed to the bulb receptacle 40. A narrow double lead wire 52 extends into the lumen 50 of the hollow tube 38 through the open bottom end 51 of the hollow tube 38. The double lead wire 52 extends up through the hollow tube 38, wherein the wire leads 55 are joined to the conductive leads 34 (FIG. 3) extending from the incandescent bulb 32. In the preferred embodiment, the wire leads 55 are soldered to the conductive leads 34 of the incandescent bulb 32, thereby creating a strong, reliable electrical connection. The double lead wire 52 extends out of the hollow tube 38 and leads to a battery source (not shown) that provides electrical power to the incandescent bulb 32. The double lead wire 52 may also extend to a control circuit (not shown) that may cause the incandescent bulb 32 to blink in sequence by selectively controlling the flow of electricity in between the battery source and the incandescent bulb.

Figure 4:
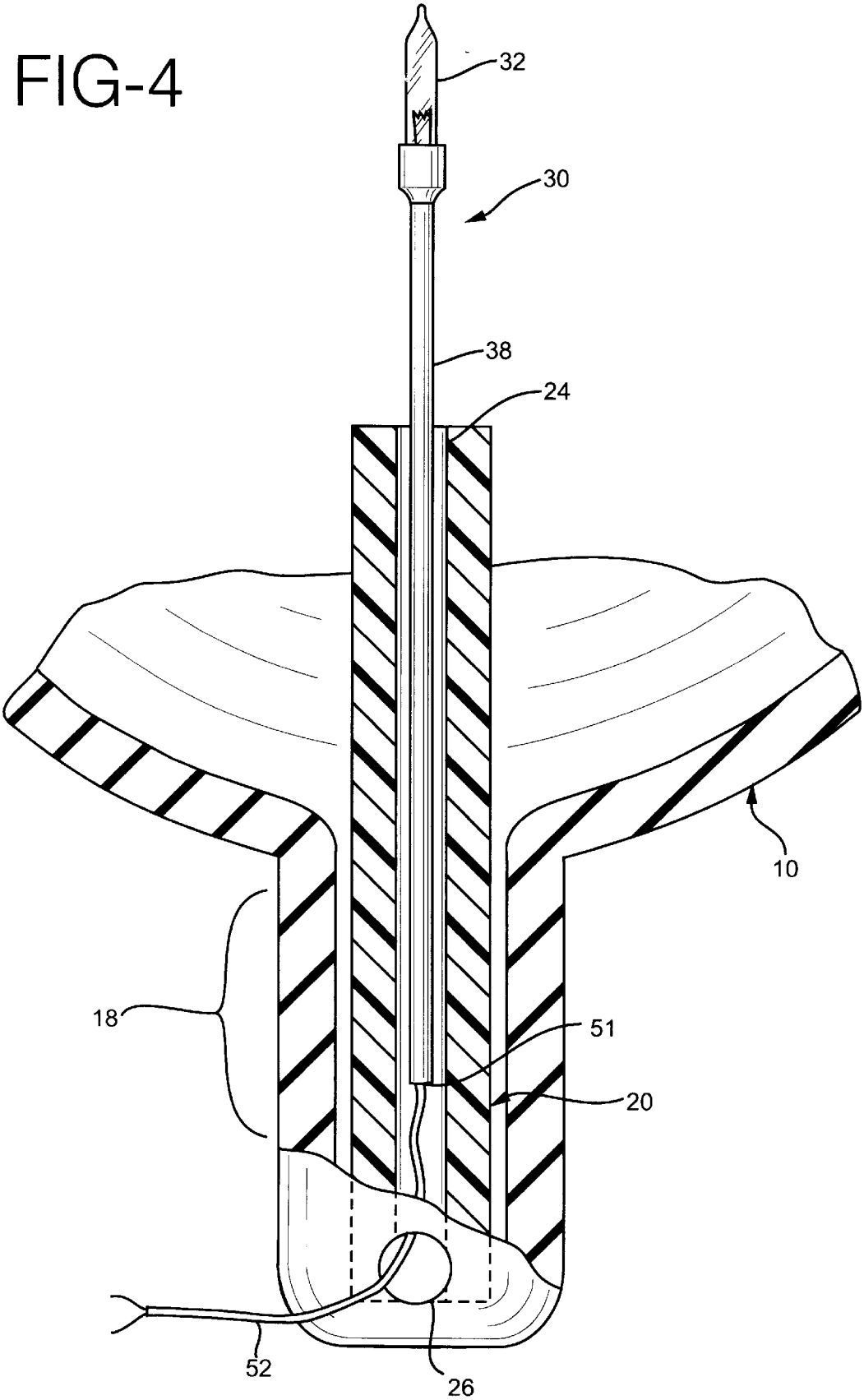
FIG. 4 shows the embodiment of the invention shown in FIG. 2 installed in a collapsible fill conduit of a mylar balloon such as that shown in FIG. 1.

Referring to FIG. 4, it can be seen that in order to use the present invention illumination device 30, the entire illumination device 30 is inserted into the fill hole 26 in the stem region 18 of the mylar balloon 10. The illumination device 30 enters the collapsible fill conduit 20 until the incandescent bulb 32 is advanced beyond the top of the collapsible fill conduit 20 within the center of the balloon 10. At such a position, the bottom end 51 of the hollow tube is positioned within the collapsible fill conduit 20 a predetermined distance above the fill hole 26. Once in this position, the mylar balloon 10 can be filled in the traditional manner because the presence of the illumination device 30 in the collapsible fill conduit 20 does not substantially limit the flow of gas into the balloon 10 through the collapsible fill conduit 20.

The narrow diameter of the hollow tube 38 supporting the incandescent bulb 32 does not substantially open the collapsible fill conduit 20. As such, once the balloon 10 is filled, and the source of filling gas removed, the central conduit 24 of the collapsible fill conduit 20 collapses around the exterior of the narrow hollow tube 38. Furthermore, below the bottom end 51 of the hollow tube 38, the central conduit 24 of the collapsible fill conduit 20 collapses around the double lead wire 52 that extends down through the collapsible fill conduit 20 and out through the fill hole 26. The collapse of the collapsible fill conduit 20 around the exterior of the hollow tube 38 and the double lead wire 52 creates an air impervious seal. Accordingly, the air or gas used to fill the balloon 10 remains trapped within the balloon 10 even with the illumination device 30 present.

Since a portion of the hollow tube 38 is present within the stem region 18 of the balloon 10, the hollow tube 38 is engaged when the stem region 18 of the balloon 10 is tied with a tether. The tying of the balloon's stem region 18 adds support to the illumination device 30, which enables the incandescent bulb 32 to be supported in the center of the balloon 10 without falling against one of the walls of the balloon 10. Consequently, the incandescent bulb 32 can be supported near the center of the mylar balloon, wherein the incandescent bulb 32 is powered by a power source external of the balloon.

It will be understood that the embodiment of the present invention described and illustrated herein is merely exemplary and a person skilled in the art can make many variations to the embodiment shown without departing from the scope of the present invention. There are many different balloon shapes and styles that may be illuminated. Since many differently shaped balloons exist, it will be understood that the shape of the present invention illumination device can be altered in order for the illumination device to properly position a light source near the center of the balloon. All such variations, modifications and alternate embodiments are intended to be included within the scope of the present invention as defined by the appended claims.

What is claimed is:

1. A balloon assembly, comprising:

a balloon of a non-elastic material having at least one translucent area, whereby light originating in the interior of said balloon is perceivable from the exterior of the balloon;

a collapsible fill conduit disposed within said balloon, wherein said collapsible fill conduit has an open first end that communicates with the interior of said balloon and an open second end that communicates with the exterior of said balloon, said collapsible fill conduit collapsing into a closed condition between said open first end and said open second end when pressure within said balloon exceeds ambient air pressure;

a tube disposed in said collapsible fill conduit, said tube having a bottom end disposed in said collapsible fill conduit and a top end extending into the interior of the balloon through said first end of said collapsible fill conduit, wherein said collapsible conduit seals against said tube when in said closed condition;

a light source coupled to said top end of said tube, wherein said light source is supported in the interior of said balloon; and a wire extending into said second end of said collapsible fill tube, wherein said wire extends into said tube and is electrically coupled to said light source.

2. The assembly according to claim 1, wherein said tube has a length of between three inches and twelve inches.

3. The assembly according to claim 1, further including a receptacle disposed at said top end of said tube, wherein said receptacle is adapted to receive and retain said light source in a fixed orientation relative said tube.

4. The assembly according to claim 3, wherein said receptacle forms an air impervious seal against said light source.

5. The assembly according to claim 3, further including adhesive disposed between said receptacle and said light source, whereby said adhesive helps retain said light source in said fixed position.

6. The assembly according to claim 3, wherein said light source is an incandescent bulb having a bulb and two leads that extend from said bulb, wherein said two leads pass into said receptacle and said receptacle seals against said bulb.

7. The assembly according to claim 6, wherein said wire is soldered to said leads of said incandescent bulb within said receptacle.

8. The assembly according to claim 1, wherein said light source is selected from a group consisting of incandescent bulbs and light emitting diodes.

9. The device according to claim 1, wherein said hollow tube has an outer diameter of less than 0.10 inches.

* * * * *